US005507492A

United States Patent [19]

Adell

[11] Patent Number: 5,507,492

[45] Date of Patent: Apr. 16, 1996

[54] COMBINED CARD AND KEY CASE AND LOTTERY NUMBER PICKER FOR DAILY AND WEEKLY LOTTERIES

[76] Inventor: Robert Adell, 31800 S. Brandingham, Franklin, Mich. 48025

[21] Appl. No.: 394,768

[22] Filed: Feb. 27, 1995

[51] Int. Cl.[6] ..... A63F 3/06

[52] U.S. Cl. ..... 273/144 B; 273/148 R; D3/208; D3/210; 150/147

[58] Field of Search ..... 273/144 B, 145 C, 273/144 R, 144 A, 145 CA, 138 A, 269; 150/147; D3/207, 208, 210

[56] References Cited

U.S. PATENT DOCUMENTS 4,403,775 9/1983 Chaput ..... 273/144 B
5,358,245 10/1994 Adell ..... 273/144 B

FOREIGN PATENT DOCUMENTS 3722430 1/1989 Germany ..... 273/144 B

*Primary Examiner*—Benjamin H. Layno
*Attorney, Agent, or Firm*—Alex Rhodes

[57] ABSTRACT

A case for cards, keys and numbered disks comprising a platform, a set of numbered disks stored in the platform, an open ended trap in the platform for capturing some of the numbered disks corresponding to a lottery number, a transparent cover on opposite sides of the platform for viewing the disks and cards stored in the case, and a chain for carrying keys. A characterizing feature of the invention is that multiple traps are provided for picking daily and weekly lottery numbers. A second characterizing feature of the invention is that the traps allow easy entry of disks and impede a flow of disks out of the traps.

12 Claims, 4 Drawing Sheets

COMBINED CARD AND KEY CASE AND LOTTERY NUMBER PICKER FOR DAILY AND WEEKLY LOTTERIES

FIELD OF THE INVENTION

This invention relates to cases and games of chance and more particularly to a combined card, key and lottery number picker case for daily and weekly lotteries.

BACKGROUND OF THE INVENTION

Government lotteries are major sources of revenue in the United States and foreign countries. Each year billion of dollars are collected to supplement taxes. The annual collections in the United States have matched the combined income of America's five most profitable corporations.

Lotteries have gained so high a degree of acceptance that it is believed that the United States government may soon adopt a national lottery for trimming its large budget deficits. Numerous foreign countries have already adopted national lotteries, including Canada, Great Britain, France, Germany, Spain, Switzerland, Australia, Ireland and Austria.

State and foreign lotteries vary considerably, especially between daily, weekly and semi-weekly lotteries. Daily lotteries require betters to match three or four digit numbers randomly selected at public drawings. Weekly and semi-weekly lotteries require betters to match sets of numbers randomly selected at public drawings. The number of choices given bettors in weekly and semi-weekly lotteries vary from 54 numbers in New York and Illinois to 25 numbers in West Virginia.

Lottery betting stations are generally found in retail establishments such as supermarkets, pharmacies and party stores. Bets are most often placed at the same check-out counters which retailers use for their ordinary business. Many betters do not select numbers until they are at a betting station. This causes congestion at check-out counters, especially when there are many betters because lottery prizes are high.

In my U.S. Pat. No. 5,358,245, an improved lottery number picker is disclosed. Although the number picker is easy to use, it is not deemed to be sufficiently compact to be more portable.

From the above, it will appreciated that if a compact, portable lottery number picker for daily, weekly and semi-weekly lotteries were available to betters, it would reduce the time for placing bets and relieve congestion at betting stations. The compact number picker would be welcomed by retailers as well as betters.

If the compact picker offered other benefits in addition to the benefit of picking lottery numbers for daily, weekly and semi-weekly lotteries, it would be more widely accepted.

SUMMARY OF THE INVENTION

The present invention is a compact case for cards, keys and numbered disks. The case generally comprises a platform, a set of numbered disks stored in the platform, an open ended trap in the platform for capturing some of the numbered disks, a transparent cover attached to opposite sides of the platform for covering and viewing the disks and cards stored in the case, and a chain for carrying keys.

A principal and characterizing feature of the invention is multiple traps for picking daily, weekly and semi-weekly lottery numbers. A second characterizing feature of the invention is the design of the traps which allows easy entry of disks and impedes disks from flowing out of the traps.

One benefit of the invention is that it can be carried in articles of clothing and ladies' purses. This benefit provides betters with a quick and easy means for picking numbers at betting stations, thereby reducing congestion, reduces waiting times and reduces interference with a proprietor's ordinary business.

Another benefit is that it can be used as an I.D. tag for luggage and brief cases, rather than for carrying keys.

A still further benefit is it can be used for storing identification cards, business cards, and advertising materials. Information can be provided on the cards, such as, vehicle registration numbers and driver license numbers which are needed when purchasing gas and other items on credit and registering at motels. The information can also be used for retrieving lost keys, in the event the case is lost. The business cards can be used by professionals and businesses to promote goodwill and to advertise their products and services.

Further benefits, features and embodiments of the invention will be apparent from the ensuing description and accompanying drawings which describe the invention in detail. A preferred embodiment is disclosed in accordance with the best mode which is contemplated for practicing the invention and the specific features in which exclusive property rights are claimed are set forth in each of the numbered claims which are appended to the detailed description.

BRIEF DESCRIPTION OF THE DRAWINGS

The invention will be better understood and further objects, characterizing features, details and advantages thereof will appear more clearly with reference to the diagrammatic drawings illustrating a presently preferred specific embodiment of the invention by way of non-limiting example only.

FIG. 19 is a rotated plan view of the embodiment shown in

FIGS. 1–5 showing how disks are captured in a trap of the device shown in FIGS. 1–8.

DETAILED DESCRIPTION OF THE PREFERRED EMBODIMENT

Figures 1, 2, 3, 4, 5:
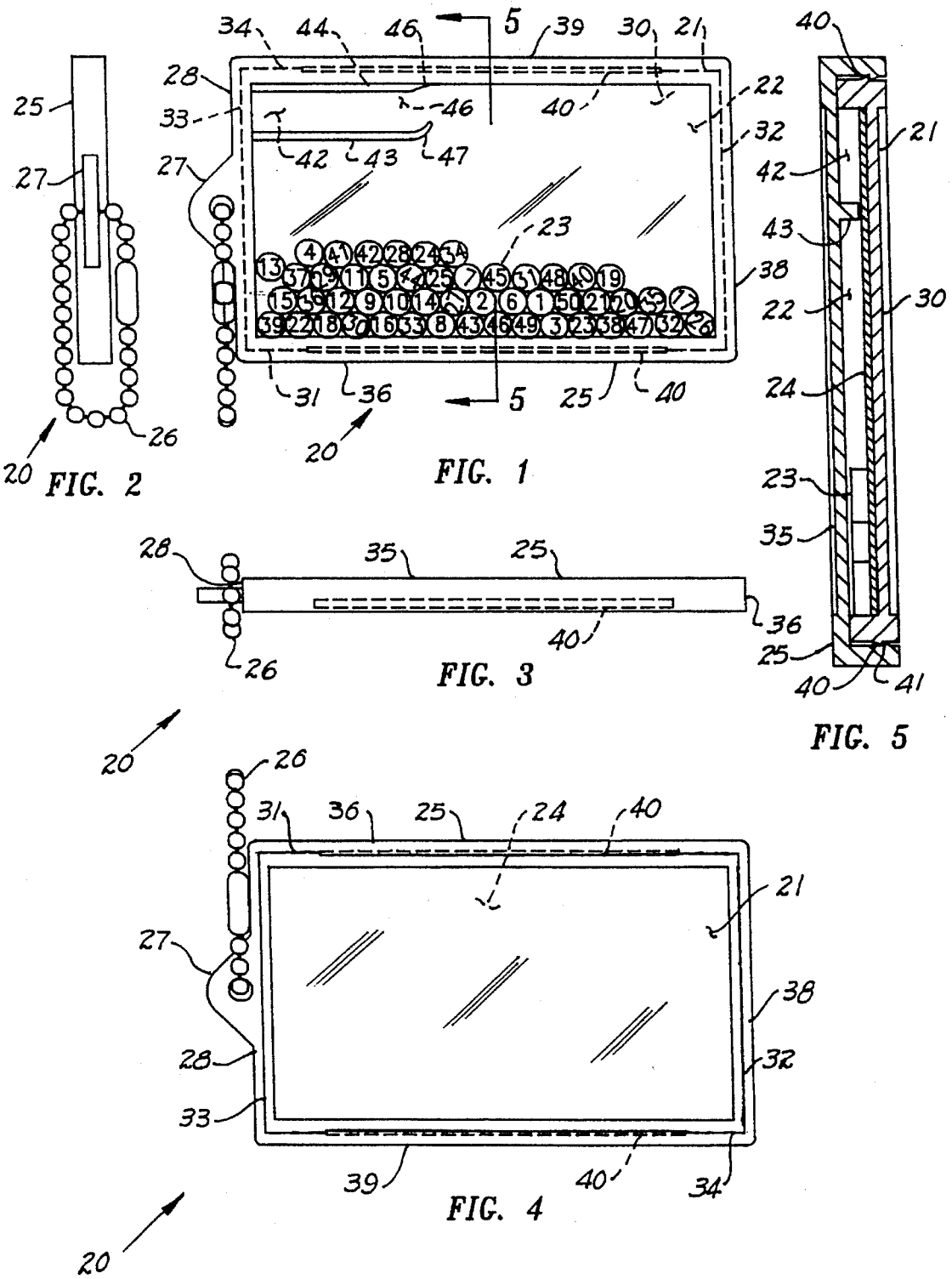
FIG. 1 is a plan view of a case for carrying cards, keys and disks and for randomly selecting sets of six numbered disks according to the present invention.
FIG. 2 is a right side view of the device shown in FIG. 1.
FIG. 3 is a front view of the device shown in FIG. 1.
FIG. 4 is a bottom view of the device shown in FIG. 1.
FIG. 5 is a cross-sectional view drawn to an enlarged scale taken on the line 5—5 in FIG. 1.
Figure 7:
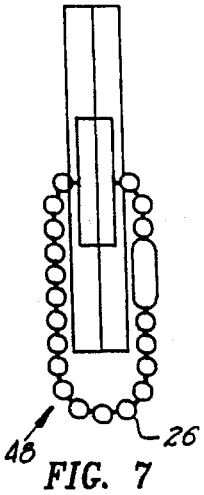
FIG. 7 is a right side view of the alternate embodiment.
Figure 6:
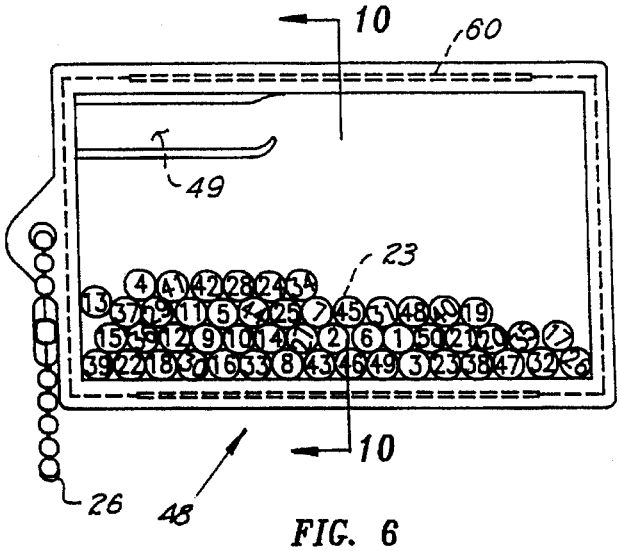
FIG. 6 is a plan view of an alternate embodiment for randomly selecting lottery numbers for daily and weekly or semi-weekly lotteries.
Figure 8:
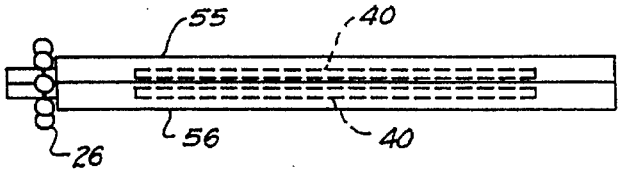
FIG. 8 is a front view of the alternate embodiment.

Referring now to the drawings wherein like numerals designate like and corresponding parts throughout the several views, in FIGS. 1 through 5, inclusive, a case 20 for carrying cards, keys, and numbered disks is shown according to the invention. The case 20 can be used as an I.D. Tag for suitcases and brief cases.

The case 20 generally comprises a rectangular shaped transparent platform 21 having a space 22 for storing numbered disks 23 and a card 24; a set of numbered disks 23 for selecting lottery numbers; a transparent cover 25 attached to the platform 21 for covering and viewing the disks 23 and a card 24. A chain 26 attached to an outward extending portion 27 of a right side wall 28 of the cover 25 for carrying keys.

In the orientation depicted in the drawings,, the platform 21 has a horizontal wall 30, a front wall 31, left side wall 32, right side wall 33, and a rear wall 34. The transparent cover 25 overlaps the platform 21 and has a horizontal wall 35, a front wall 36, a right side wall 28, a left side wall 38, and a rear wall 39.

With reference to FIG. 5, longitudinal ribs 40 extend along the outside surface of the platform front 31 and rear 34 walls and the inside surfaces of the cover front 36 and rear 39 walls. The ribs 40 interlock to retain the cover 25 to the platform 21. As shown in the enlarged cross-sectional view of FIG. 5, the ribs 40 are sloped to facilitate interlocking. It should be noted from FIG. 5, that when the ribs 40 are interlocked, their adjacent surfaces 41 are steeply sloped to prevent the ribs from being easily separated.

Referring to FIG. 1, the end portions of the ribs are offset from the sides of cover 25 and the platform. The offsets reduce the rigidity of the cover walls 28, 38 and platform walls 31, 34 and allow them to flex during the interlocking of the ribs 40.

Figure 17:
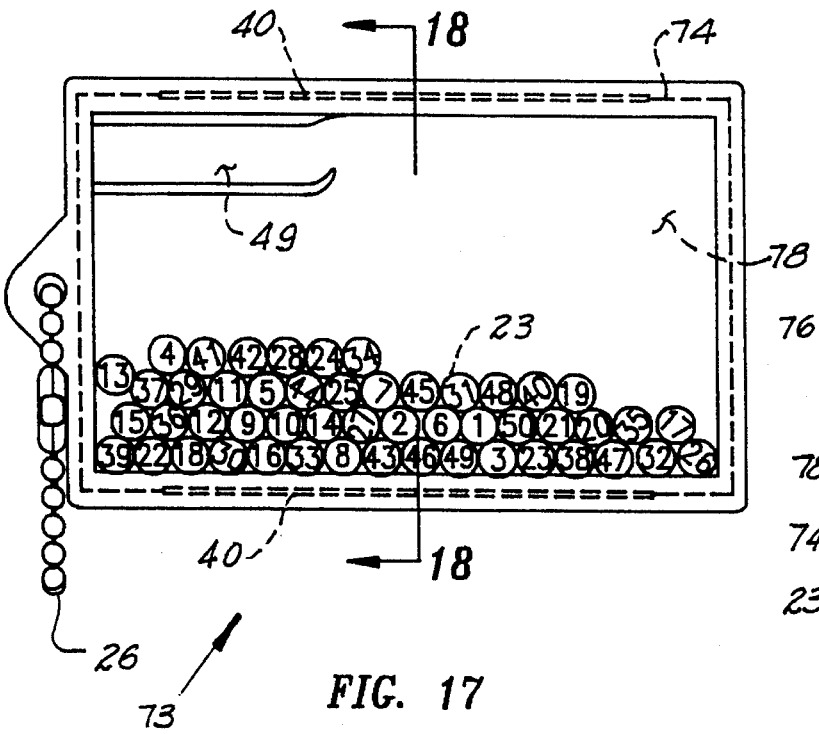
FIG. 17 is a plan view of an embodiment wherein a card is bonded to an outside surface of a case.

Referring now to FIGS. 1 and 17, a characterizing feature of the invention is a trap 42 for capturing disks. The trap 42 allows disks 23 to easily enter but having entered, impedes them from easily leaving the trap 42. The length of the trap 42 corresponds to the number of disks 23 which must be captured. The trap length does not allow extra disks 23 to be captured. In the illustrated embodiment, six disks 23 are captured from a set of fifty disks. To this purpose, the trap 42 allows six disks 23, and only six disks 23, to be captured.

The trap 42 has an inner wall 43 and a parallel outer wall 44 which extend downwardly from an inner surface of the cover 25 and are parallel to the platform's rear wall 34. An end portion 45 of the trap's outer wall 44 is sloped to provide a ramp 45 at the entrance 46 of the trap. An end portion 47 of the trap's inner wall 43 is hook-shaped and turns outwardly toward the trap's outer wall 44.

The operation of the trap 42 can be best understood by reference to FIG. 17. To select a lottery number, the case 20 is rotated to empty the trap of disks 23. The case 20 is agitated to randomize the positions of the disks 23 and rotated to capture six of the disks 23. As the case 20 is rotated to capture disks 23, some disks 23 accumulate at the entrance 46 of the trap 42, forcing other disks 23 up the ramp 45 and into the trap 42. The upward movement of disks 23 on the ramp 45 pushes other disks 23 out of the path of disks 23 on the ramp 45.

When the case 20 is rotated further such that the trap 42 becomes horizontal, the trap's hook-end portion 47 impedes disks 23 from flowing out of the trap 42. With reference to FIG. 5, in the interior of the case 20, between the trap 42 and the horizontal platform wall is an opaque card 24. The card is installed before the disks 23 and cover 25 are installed.

Referring now to FIGS. 6 through 10, an alternate embodiment 48 is shown having an upper space 53 with a single trap 49 for a six number weekly lottery and a lower space 54 with a pair of traps 50, 51 for three and four digit daily lotteries. The traps 49, 50, 51 are formed in a transparent upper cover 55 and a transparent lower cover 56. The covers 55, 56 overlap a platform 52 and are attached to the platform 52 with pairs of interlocking ribs 40.

Figure 10:
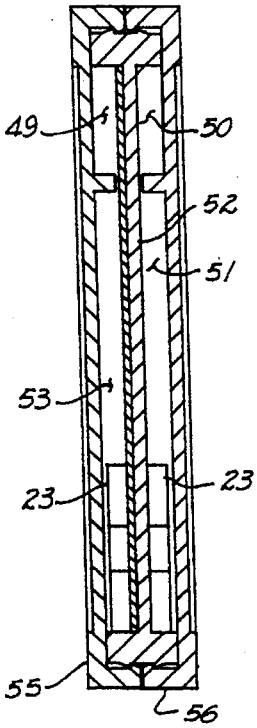
FIG. 10 is an enlarged cross-sectional view taken on the line 10—10 in FIG. 8.
Figure 9:
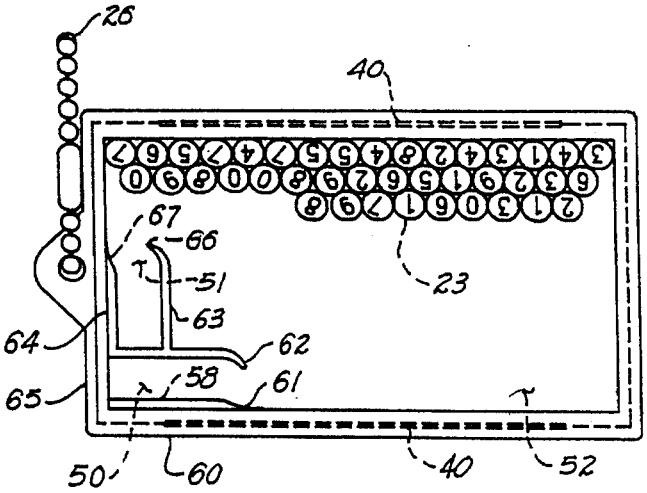
FIG. 9 is a bottom view of the alternate embodiment.
Figure 12:
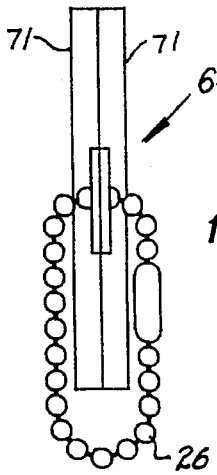
FIG. 12 is a right side view of the embodiment shown in FIG. 11.
Figure 11:
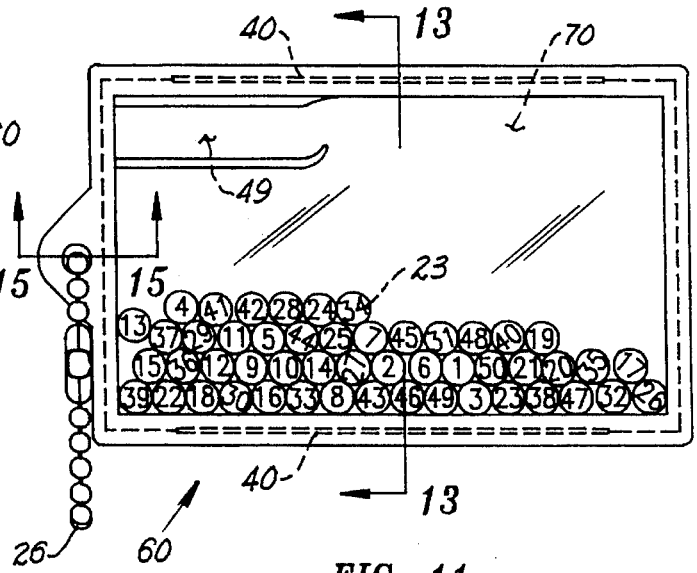
FIG. 11 is a plan view of a case for carrying keys and disks and a lottery number picker for randomly selecting three digit numbers, four digit numbers and sets of six numbered disks, according to the invention.
Figure 13:
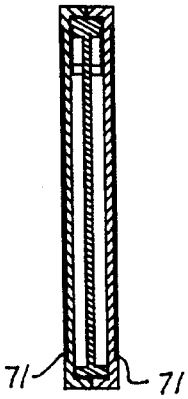
FIG. 13 is a cross-sectional view taken on the line 13—13 in FIG. 11.
Figure 14:
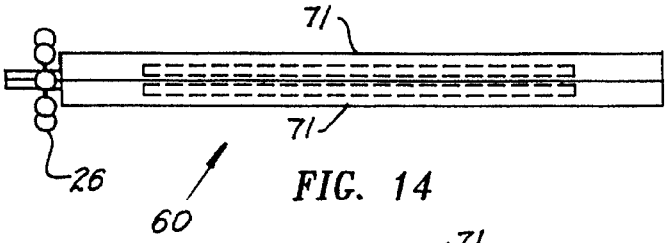
FIG. 14 is a front view of the embodiment shown in FIG. 11.
Figure 15:
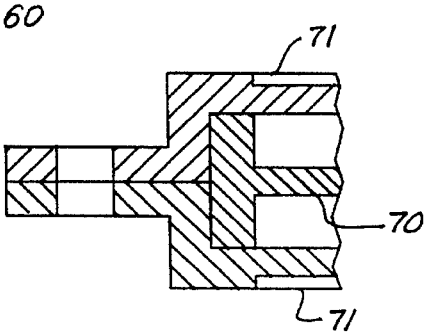
FIG. 15 is an enlarged cross-sectional view taken on the line 15—15 in FIG. 11.
Figure 16:
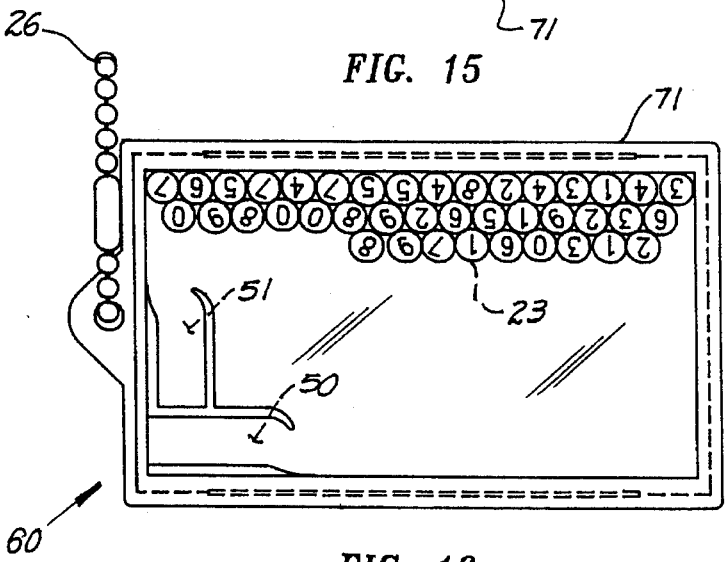
FIG. 16 is a bottom view of the embodiment shown in FIG. 11.

With reference to FIGS. 9 and 10, the traps 50, 51 in the lower cover are orthogonal and extend from an inside surface of the lower cover 56 for picking three and four digit daily lottery numbers. The trap 49 for picking six of the numbered disks 23 extends from an inside surface of the upper cover 55 and has the same configuration as the trap 42 of the first described embodiment 20. The trap 50 for capturing four of the numbered disks 23 is comprised of an outer wall 58 and a parallel spaced apart inner wall 59. Both walls 58, 59 are parallel to the lower cover's rear wall 60. The trap 50 has ramp 61 and hook 62 end portions.

Referring to FIG. 9, the trap 51 for capturing three of the numbered disks 23 has an outer wall 63 and an inner wall 64 extending from the inner wall 59 of the trap 50 and parallel to the lower cover's right side wall 65, and hook-shaped 66 and ramp 67 end portions.

Referring now to FIGS. 11 through 16, an embodiment 60 is shown which is similar to the embodiment 48 of FIGS. 6 through 10 except that upper 49 and lower 50, 51 traps are formed in a platform 70 and the card 24 has been deleted. It will be observed that identical covers 71 have been used in this embodiment 60 because the traps 49, 50, 51 are incorporated in the platform 70.

Figure 18:
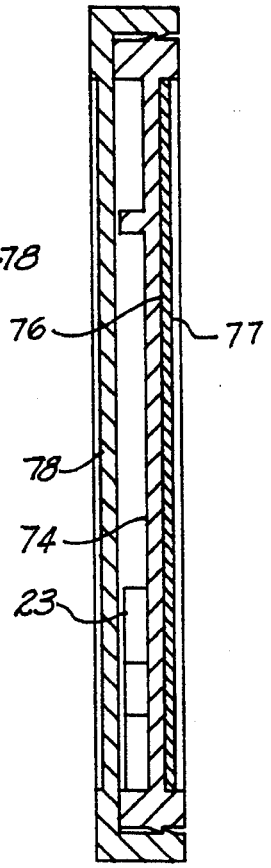
FIG. 18 is a cross-sectional view taken on the line 18—18 in FIG. 17.

In FIGS. 17 and 18, I have shown an embodiment 73 having a transparent platform 74, a transparent cover 78 and a card 75 which is adhesively bonded to a lower surface of the platform 74. It will be noted that the upper 76 and lower 77 surfaces of the card are visible through the cover 78. Thus, information, such as instructions and manufacturer identification can be seen on the upper surface 76 of the card, and other information, such as advertising can be seen on the lower surface 77 of the card.

From the foregoing, it will be appreciated that my invention provides a compact case for cards, keys, and numbered disks having characterizing features and advantages over the prior art.

Although only several embodiments of my invention have been shown for the purpose of describing my invention and the manner of using the invention, it is not my intention to limit the claims to these embodiments, since other embodiments become obvious after having the benefit of the disclosure, by such changes as shape, material and arrangement of parts without departing from the spirit thereof.

I claim:

1. A compact case for cards, keys and numbered disks, said case comprising a platform, said platform having a horizontal wall and surrounding front, side and rear walls, a space above said horizontal wall for storing numbered disks and a card, an open ended trap in said space for capturing an established quantity of numbered disks stored in said upper space, said trap having a pair of parallel walls; a card stored in said platform adjacent to said horizontal wall; a plurality of disks stored in said upper space; a transparent cover attached to said platform, in overlapping relationship to said platform for covering said disks and viewing said card and said disks in said platform, said cover having an outward extending end portion with an aperture for attaching a key chain.

2. The apparatus recited in claim 1 wherein said platform, said card and said cover are rectangular shaped.

3. The apparatus recited in claim 1 wherein said platform is transparent.

4. The apparatus recited in claim 3 wherein said card is adhesively bonded to a lower surface of said horizontal wall of said transparent platform, said card having an upper surface with indicia which are visible through said transparent platform.

5. The apparatus recited in claim 1 further comprising a lower space in said platform for storing a second plurality of numbered disks, said platform having at least one trap for capturing an established number of said disks which are stored in said second space, said second trap comprised of a pair of parallel walls, one of said walls having a hook-shaped end portion, and the other of said walls having a ramp portion; a second plurality of numbered disks stored in said lower space; a transparent cover attached to a lower portion of said platform for covering and viewing said disks in said lower space of said platform.

6. The apparatus recited in claim 5 further comprising a second trap in said lower space of said platform for capturing a second established number of disks which are stored in said lower space.

7. The apparatus recited in claim 1 further comprising a chain for receiving keys, said chain attached to said end portion of said cover and extending through said aperture of said end portion.

8. The apparatus recited in claim 1 wherein said trap is a portion of said cover.

9. The apparatus recited in claim 1 wherein said trap is a portion of said platform.

10. A compact case for cards, keys and numbered disks, said case comprising: a platform, said platform having a horizontal wall and surrounding front side and rear walls, a space above said horizontal wall for storing numbered disks and a space below said horizontal wall for storing numbered disks, said upper space having a trap for capturing an established number of said numbered disks for placing a bet in a lottery, said lower space having a pair of orthogonal related traps for capturing numbered disks for placing bets in a different lottery, each of said traps in said upper and said lower spaces having a pair of parallel walls, one of each pair of said parallel walls having a hook-shaped end portion, and the other of said parallel walls having a ramp-shaped end portion; and a pair of transparent covers attached in overlapping relationship to upper and lower portions of said platform for covering and viewing disks in said upper and said lower spaces; at least one of said covers having an outward extending end portion with an aperture for attaching a key chain; a card stored in said upper space; a first plurality of numbered disks in said upper space; and a second plurality of numbered disks stored in said lower space.

11. The apparatus recited in claim 10 further comprising a chain attached to said outward extending end portion of said cover, said chain extending through said aperture.

12. A compact case for cards, keys and numbered disks, said case comprising a generally rectangular shaped transparent platform, said platform having a horizontal wall and surrounding front, side and rear walls, an upper space above said horizontal wall for storing a card and numbered disks, an open ended trap in said upper space for capturing an established quantity of numbered disks stored in said upper space, a lower space below said horizontal wall for storing numbered disks, a pair of orthogonal related open ended traps in said lower space for capturing established quantities of numbered disks stored in said second space, each of said traps having a pair of parallel walls, one of said walls having a hook-shaped end portion, and the other of said walls having a ramp end portion; a plurality of disks stored in said upper space and said lower space; a first puerility of numbered disks in said upper space for randomly generating numbers for placing bets in lotteries; a card between said numbered disks and said horizontal wall in said upper space; a second plurality of numbered disks in said lower space for randomly generating numbers for placing other bets in lotteries; a card in said upper space between said numbered disks and said horizontal wall; and a pair of transparent covers attached to said platform, in overlapping relationship to said platform for covering and viewing said disks and said card in said upper space and said disks in said lower space.

* * * * *

UNITED STATES PATENT AND TRADEMARK OFFICE

CERTIFICATE OF CORRECTION

PATENT NO. : 5,507,492
DATED : April 16, 1996
INVENTOR(S) : Robert Adell

It is certified that error appears in the above-indentified patent and that said Letters Patent is hereby corrected as shown below:

In column 3, delete lines 10-14.

Figure 19:
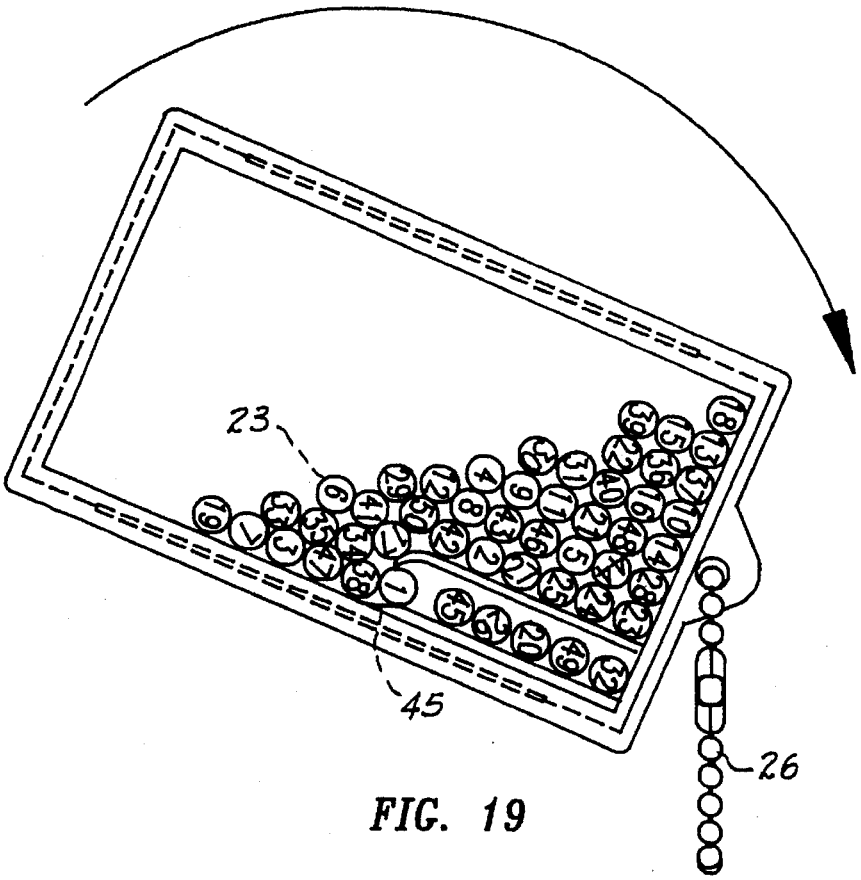
FIG. 19 is a plan view of an alternate embodiment which is similar to the embodiment of FIGS. 1 through 5, except that a card is bonded to a bottom surface of a platform.

In column 3, beginning on line 15, change the description of FIG. 19 to read

> FIG. 19 is a rotated plan view of the embodiment shown in FIGS. 1-5 showing how disks are captured in a trap.

In column 6, line 40, change "puerility" to --plurality--

Signed and Sealed this

Twenty-first Day of January, 1997

*Attest:*

Bruce Lehman

BRUCE LEHMAN

*Attesting Officer*

*Commissioner of Patents and Trademarks*